United States Patent [19]

Doublet et al.

[11] 4,377,552

[45] Mar. 22, 1983

[54] NUCLEAR REACTOR EXCHANGER

[75] Inventors: Philippe Doublet, La Varenne; Georges Jullien, St Michel sur S/Orge, both of France

[73] Assignee: Novatome, Le Plessis Robinson, France

[21] Appl. No.: 100,873

[22] Filed: Dec. 6, 1979

[30] Foreign Application Priority Data

Dec. 12, 1978 [FR] France ..... 78 34945

[51] Int. Cl.[3] ..... G21C 15/02; F28F 7/00; F28F 9/02

[52] U.S. Cl. ..... 376/405; 165/83; 165/158

[58] Field of Search ..... 165/81, 83, 157-161; 122/32, 34; 376/359, 399, 405

[56] References Cited

U.S. PATENT DOCUMENTS

| | | | |
|---|---|---|---|
| 2,468,903 | 5/1949 | Villiger | 165/83 X |
| 3,187,808 | 6/1965 | Kuhne et al. | 165/83 |
| 3,189,086 | 6/1965 | Esser et al. | 165/83 X |
| 3,741,167 | 6/1973 | Polcer | 122/32 |
| 3,850,231 | 11/1974 | Creek | 165/83 |
| 3,908,756 | 9/1975 | Richardson | 165/158 |

FOREIGN PATENT DOCUMENTS

| | | | |
|---|---|---|---|
| 962171 | 4/1957 | Fed. Rep. of Germany | 165/157 |

*Primary Examiner*—William R. Cline
*Assistant Examiner*—Theophil W. Streule, Jr.
*Attorney, Agent, or Firm*—Pollock, Vande Sande & Priddy

[57] ABSTRACT

Nuclear reactor exchanger which assures the transfer of heat between two streams of coolant sodium. It includes an outlet connector which channels coolant sodium leaving a bundle of exchanger tubes traversed on the inside by the sodium and immersed externally in coolant sodium, and an inner tubular jacket forming a surface of revolution about a vertical axis and an outer tubular jacket. The wall of the inner jacket has a folded portion distinguished by at least one flank in the form of a crown.

5 Claims, 5 Drawing Figures

NUCLEAR REACTOR EXCHANGER

FIELD OF THE INVENTION

The present invention relates to improvements in a nuclear reactor exchanger which assures the transfer of heat between two streams of coolant liquid sodium.

The exchanger in accordance with the invention is intended for use as an intermediate sodium-sodium exchanger in a fast-neutron reactor.

BACKGROUND

An intermediate exchanger for a fast-neutron reactor transfers the heat from a stream of radioactive primary liquid sodium to a stream of non-radioactive secondary liquid sodium, while assuring physical separation between them. The primary liquid sodium is reheated by the core of the reactor and circulates in the vessel as far as the intermediate exchangers. The exchange of heat between the primary sodium and the secondary sodium is achieved by way of a bundle of tubes. Generally the secondary sodium circulates inside the tubes while the primary sodium circulates outside these tubes. The primary sodium and the secondary sodium circulate in contraflow. The circulation of the radioactive primary sodium outside the tubes facilitates the draining. Furthermore the secondary sodium operates at a higher pressure than that of the primary sodium and it is more economical to make the sodium at high pressure flow in the tubes. The tubes forming the tube bundle are generally vertical.

Different designs of intermediate sodium-sodium exchange for fast-neutron reactors are known. In accordance with one of these designs, the secondary sodium arrives above the tube bundle, the exchanger tubes of which are straight. This exchanger comprises a vertical inlet tube which is connected at its top end to the secondary sodium inlet. It channels a descending stream of relatively cold secondary sodium. This sodium is at a relatively high pressure (normally of the order of 6 bars, and exceptionally 18 bars in cases of accidental operation). This inlet tube is surrounded at its bottom portion by the tube bundle and it opens out below the bottom tube plate of this bundle. The secondary sodium leaving the inlet tube is confined in an inlet collector and rises in the exchanger tubes of the tube bundle. The secondary sodium is heated progressively by the primary sodium as it proceeds through the tubes of the tube bundle. The rising stream of reheated secondary sodium is channeled at the outlet from the tube bundle by an outlet collector extending vertically. This outlet collector consists of an inner tubular jacket and an outer tubular jacket which are coaxial and connected together and the top portion of the exchanger. These two jackets envelop the inlet tube for the secondary sodium. The outer jacket is provided with an outlet for discharge of the relatively hot secondary sodium.

The assembly formed by the tube bundle, the tube plates and the outlet collector is subjected to combined stresses due to forces from pressure and to forces from thermal dissymmetries in the tube bundle and in the outlet collector. The thermal forces are relatively large and are inherent in the design of the exchanger.

It has been observed that the exchanger tubes in the tube bundle have different average temperatures depending upon their positions with respect to the axis of symmetry of the bundle. This phenomenon tends to make the tube plates bend.

Furthermore it has been observed that a considerable temperature gradient exists in the secondary sodium flowing downstream of the upper tube plate of the tube bundle. The temperature increases as one goes horizontally from the inner jacket towards the outer jacket. This gradient causes considerable strains and deformations in the assembly immersed in the secondary sodium. The relative rigidity of the collector and of the tube bundle is such that the differential expansion of the inner jacket and of the outer jacket shows up as serious deformations of this assembly.

SUMMARY OF THE INVENTION

The object of the present invention is an outlet collector which channels the sodium leaving the tube bundle of an exchanger and the inner jacket of which is capable of standing relative displacements of thermal origin without significant strain and without transmitting any serious force to the tube bundle. The variations in temperature over the jackets of the outlet collector do not modify in any serious fashion the mechanical equilibrium of the assembly of the exchanger. The differential displacements of thermal origin are absorbed within the effects of pressure upon the outlet collector having disastrous repercussions.

The exchanger according to the invention includes an outlet collector which channels coolant sodium leaving a bundle of exchanger tubes trasversed on the inside by the said sodium and immersed externally in coolant sodium, and which comprises an inner tubular jacket forming a surface of revolution about a vertical axis and an outer tubular jacket, and it is essentially characterized by the fact that the wall of the inner jacket exhibits a folded portion distinguished by at least one flank in the form of a crown.

In accordance with one characteristic of the invention, the folded portion forms at least two flanks joined by a collar.

BRIEF DESCRIPTION OF THE DRAWINGS

The invention will now be described in greater detail by referring to several embodiments given by way of example and represented in the attached drawings.

DETAILED DESCRIPTION

Figure 1:
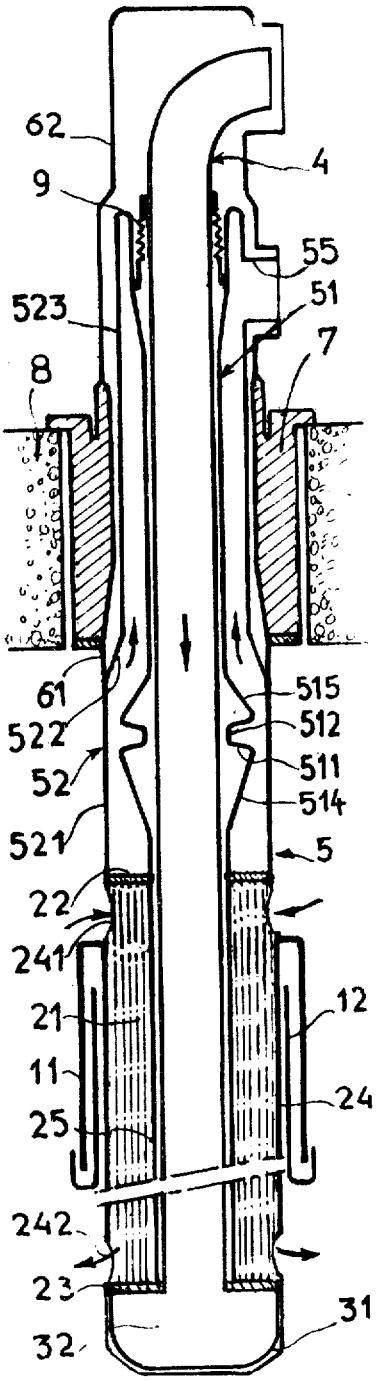
FIG. 1 is a vertical axial section of a first embodiment of the exchanger in accordance with the invention.

The intermediate exchanger represented in FIGS. 1 to 5 is arranged vertically in the reactor vessel. The vessel contains a mass of coolant liquid sodium which serves to convey the heat. This sodium is radioactive and is called primary sodium.

The exchanger has exchanger tubes 21 which are either totally straight or partially straight. In this latter case, each of the exchanger tubes is equipped with an expansion curve. These tubes are grouped as a bundle and are fixed at their ends into the tube plates 22 and 23. Each of these tube plates has the form of a crown. The bundle of tubes 21 is located between an outer cylindrical sleeve 24 and an inner cylindrical sleeve 25 coaxial with the said outer sleeve. The outer sleeve 24 comprises inlet windows 241 which are located below and close to the upper tube crown 22. It furthermore comprises outlet windows 242 which are located above and close to the lower tube crown 23. The primary sodium circulates from the top downwards round the exchanger tubes 21. The primary sodium which enters through the inlet windows 241 is at a temperature lying approximately between 540° and 580° C. The primary sodium which leaves the outlet windows 242 is at a temperature lying approximately between 380° and 400° C. The physical separation between the relatively hot primary sodium and the relatively cold primary sodium is assured by a sealing bell 11 and a shaft 12 which forms part of an assembly which is not shown.

The stream of primary sodium heats a stream of non-radioactive sodium called the secondary sodium. The inlet of the secondary sodium is effected at the top of the exchanger. The secondary sodium is led down to the bundle of tubes 21 by an inlet tube 4 the greater length of which has the shape of a cylinder the vertical axis of which coincides with the axis of the sleeves 24 and 25 of the bundle. This inlet tube 4 passes inside the inner sleeve 25 of the bundle of tubes 21. These exchanger tubes 21 are arranged in parallel with the vertical axis of the inlet tube and they surround it at its bottom portion. The inlet tube 4 channels a descending stream of relatively cold secondary sodium. An inlet collector 31 which forms a chamber 32 confines the secondary sodium from the outlet from the inlet tube 4 down to the inlets to the tubes 21, which are flush with the lower tube crown 23.

The secondary sodium circulates inside the exchanger tubes 21. The rising stream of secondary sodium is opposed to the descending stream of the primary sodium. At the inlet to the exchanger tubes 21, i.e., at the level of the tube crown 23, the secondary sodium is relatively cold. At the outlet from the exchanger tubes 21, i.e., at the level of the upper tube crown 22, the secondary sodium is relatively hot.

The secondary sodium is channelled at the outlet from the exchanger tubes 21 by an outlet collector 5 having a generally annular shape. In this outlet collector the secondary sodium has a rising movement as far as a branching 55 of the outlet tube. This outlet collector consists of an inner tubular jacket 51 and an outer tubular jacket 52. These two jackets are coaxial. Each of the jackets of the outlet collector has a general form of revolution about the vertical axis of the inlet tube 4. The inner jacket 51 surrounds the inlet tube 4 and its diameter is very slightly greater than that of this inlet tube. The outer jacket comprises a lower cylindrical sleeve 521 and an upper cylindrical sleeve 523 the diameter of which is less than that of the said lower sleeve. A frusto-conical sleeve 522 which converges in the direction of flow of the secondary sodium connects the two coaxial sleeves 521 and 523. These two jackets 51 and 52 are connected together at the top end by a toroidal head so as to form an annular chamber.

An outer envelope 61 is welded to the lower sleeve of the outer jacket of the outlet collector. This envelope extends upwards to envelop the upper sleeve of the outer jacket. It is integral with a plug 7 which is supported by the slab 8.

A sealing bellows 9 isolates the annular space lying between the inner jacket 51 and the inlet tube 4 from the upper chamber bounded by the outer jacket 52 and the envelope 62. This chamber contains a gas.

The wall of the inner jacket 51 exhibits a folded portion at least one fold of which is distinguished by a flank 511 which has the shape of a crown inscribed between two imaginary cylinders C1 and C2 centered upon the axis of symmetry, and the diameters of which are different. This folded portion forms a surface of revolution round the vertical axis of the sleeves of the tube bundle and of the inlet tube 4 and of an adjoining cylindrical portion 516. The flanks 511 are substantially plane or slightly frusto-conical. In this latter case, the angles at the apex of the cones which envelop them are substantially equal and close to 180°. Two adjacent flanks 511 may be connected together by an intermediate collar 512 of small diameter, thus forming from them as a hollow an annular throat 53 open towards the outer jacket. Two adjacent flanks 511 may be connected together by an outer collar 513 of large diameter, forming from them as a projection an annular tooth. Each inner or outer collar preferably has a cylindrical or toroidal shape. When the wall forms a number of flanks, it forms an alternation of throats and teeth, each flank being connected by an inner collar and by an outer collar to two other flanks bordering it.

Figure 2:
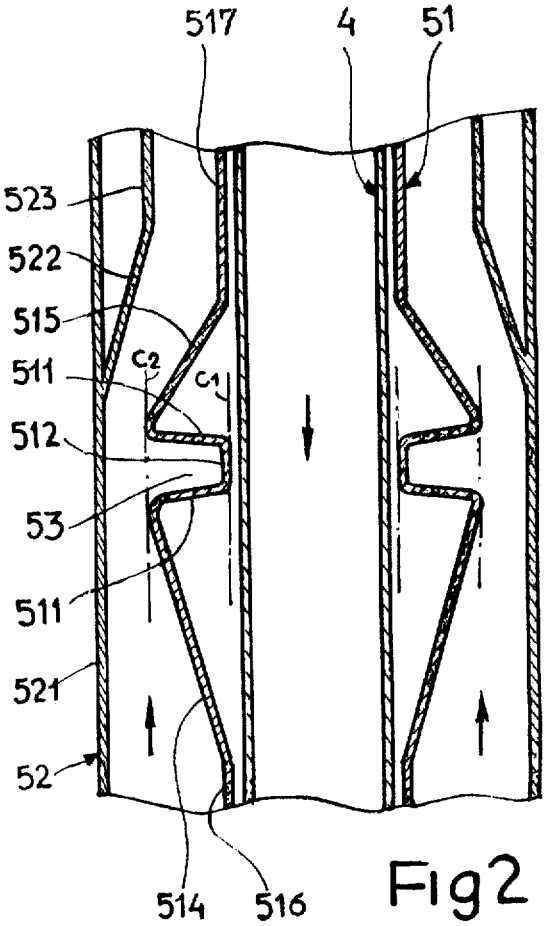
FIG. 2 represents a detail of the outlet collector of the exchanger illustrated in FIG. 1.

In the embodiment of FIGS. 1 and 2, the wall is profiled so as to form two opposed flanks 511 which form an outer annular throat 53. These flanks are connected to a lower connector sleeve 514 and an upper connector sleeve 515. The annular throat 53 is boxed in between these two sleeves and is immersed in the secondary sodium. The collar of small diameter 512 forms the bottom of this throat. The folded portion formed by the two opposed flanks 511 is located inside the sleeve 521 in the portion of the chamber of the collector having the greatest cross-section. Thus it is located on the one hand above and close to the tube bundle and more especially the upper tube crown 22, and on the other hand below the mouth of the upper sleeve 523. The connector sleeve 514 has a generally frusto-conical shape widening upwards. The small diameter of this connector sleeve 514 is integral with the cylindrical portion 516 of the jacket. The upper connector sleeve 515 has a generally frusto-conical shape widening downwards. The small diameter of this upper sleeve is integral with the cylindrical portion 517 of the jacket.

Figure 3:
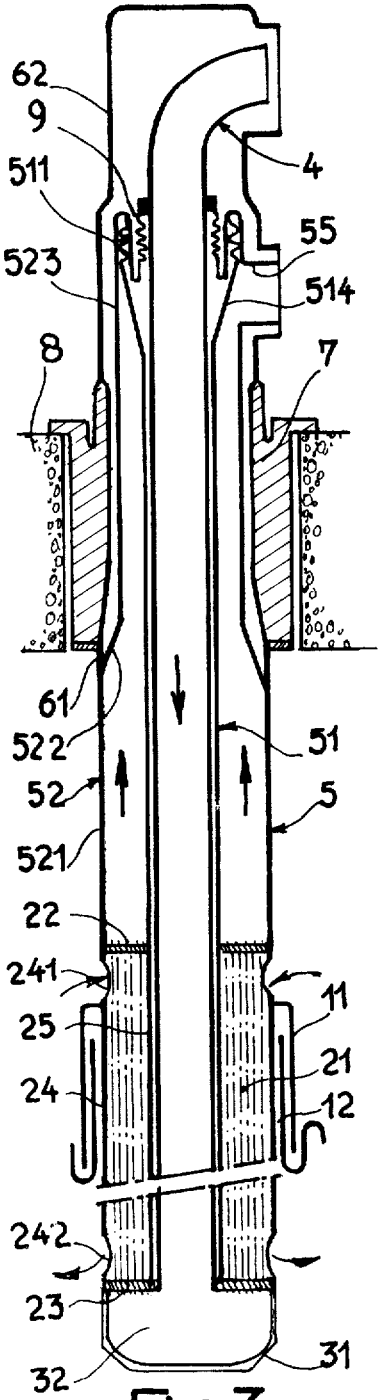
FIG. 3 is a vertical axial section through a second embodiment of the exchanger in accordance with the invention.
Figure 4:
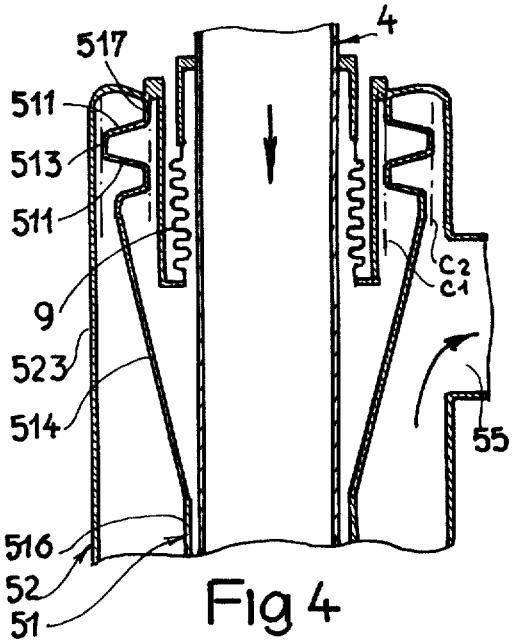
FIG. 4 represents a detail of the output collector of the exchanger illustrated in FIG. 3.

In the embodiment of FIGS. 3 and 4, the folded portion of the wall of the inner jacket forms an annular tooth distinguished by two flanks 511 and by the outer collar 513. This folded portion of the jacket is connected at the underside to a frusto-conical sleeve 514 widening upwards which prolongs the lower cylindrical sleeve 516. The outer collar 513 which connects the flanks 511 externally forms the crest of the fold. This folded portion is arranged high up close to the toroidal head connecting the upper portions of the two jackets. Hence it is located round the bellows 9 and above the branch 55 through which the secondary sodium leaves, and inside the sleeve 523. It is connected at the top by the sleeve 517 to this toroidal head.

Figure 5:
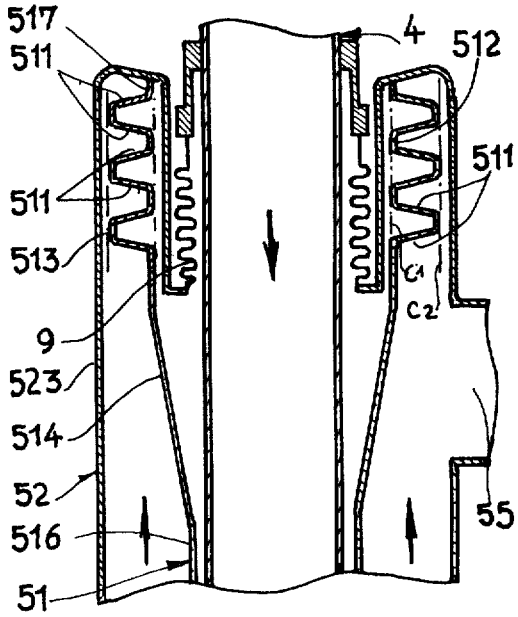
FIG. 5 represents a variant of FIG. 4.

In the embodiment of FIGS. 3 and 5, the folded portion of the wall of the inner jacket exhibits a number of flanks 511 which form at least two throats and/or at least two teeth centered upon the vertical axis of the sleeves of the tube bundle. The outer edges of the flanks are joined by outer collars 513 of large diameter. The inner edges are joined by inner collars 512 of small diameter arranged alternately with the collars 513. This folded portion is arranged close to the toroidal head connecting the upper portion of the inner jacket and the upper portion of the outer jacket round the bellows 9 and above the branch 55. It is connected at the underside to the frusto-conical sleeve 514 which widens upwards in prolongation of the sleeve 516, and it is connected at the top by the sleeve 517 to the toroidal head.

The wall of the inner metal jacket 51 in the folded zone has a thickness only slightly different from or equal to the thickness of the cylindrical portions of this jacket. The thickness of the wall forming the folded portion lies between 10 and 30 mm. The ratio between the minimum thickness of the wall of the fold and the thickness of the wall in the cylindrical portions lies between 0.6 and 1.

What is claimed is:

1. A heat exchanger for a fast neutron reactor, comprising (a) a bundle of tubes fixed at their ends to upper and lower tube plates each having the form of crown, said tubes being located between outer and inner sleeves for channeling a stream of primary sodium circulating around said tubes;

(b) an inlet tube passing inside said inner sleeve for leading a stream of secondary sodium to the inlets of said tubes, so that said secondary sodium circulates within said tubes;

(c) an inner tubular jacket surrounding the said inlet tube and an outer tubular jacket connected together at the top so as to form an annular chamber which channels said secondary sodium at the outlets from said tubes, said inner tubular jacket having a folded portion comprising at least one flank and forming at least one annular throat.

2. A heat exchanger according to claim 1, wherein the wall of said folded portion of said inner tubular jacket has a thickness in the range of 10 to 30 mm.

3. A heat exchanger according to claim 1 or 2, wherein said folded portion is connected towards its underside to a substantially frusto-conical sleeve which widens upwardly and is in turn connected to a cylindrical portion.

4. A heat exchanger according to claim 1 or 2, wherein said folded portion is located close to said tube bundle.

5. A heat exchanger according to claim 1 or 2, wherein said folded portion is located close to the top portion of said inner tubular jacket.

* * * * *